United States Patent [19]

Marchant

[11] Patent Number: 4,624,628

[45] Date of Patent: Nov. 25, 1986

[54] DOUBLE-DIAPHRAGM PUMPS

[75] Inventor: Derek N. Marchant, Hurstpierpoint, England

[73] Assignee: Flotronics AG, Zug, Switzerland

[21] Appl. No.: 795,665

[22] Filed: Nov. 6, 1985

[30] Foreign Application Priority Data

Nov. 6, 1984 [GB] United Kingdom ..... 8428013

[51] Int. Cl.[4] ..... F04B 43/06

[52] U.S. Cl. ..... 417/393

[58] Field of Search ..... 417/393, 396, 404

[56] References Cited

U.S. PATENT DOCUMENTS 2,307,566 1/1943 Browne ..... 417/393

3,307,484 3/1967 Hammelmann ..... 417/393

3,349,995 10/1967 Sheesley ..... 417/393 X

*Primary Examiner*—Leonard E. Smith

*Attorney, Agent, or Firm*—Wenderoth, Lind & Ponack

[57] ABSTRACT

A double diaphragm pump comprises a center body 10 and two end-caps 11, 12, the outer peripheries of two diaphragms 20, 21 being clamped between the center body and the two end-caps respectively. The diaphragms are interconnected by a hollow push-rod 26 slidably and sealingly mounted in a bush 17 in the center body. A shaft 30 extends centrally through the push-rod, diaphragm and end-cap and has a radial flange at one end and a nut engaged on a screw-thread at its other end whereby the end-caps, diaphragm and center body are clamped axially together. Air under pressure is supplied to the two axially outer chamber 23, 24 formed between the diaphragms and the end-caps under the control of a change-over spool valve 45, change-over operation of which is initiated by the approach of the push-rod 26 to either end of its reciprocating movement.

6 Claims, 2 Drawing Figures

DOUBLE-DIAPHRAGM PUMPS

This invention relates to pumps of the kind known as double-diaphragm pumps.

According to this invention there is provided a pump having a casing comprising a centre body and two end-caps disposed at opposite axial sides of the centre body and forming with centre body respective spaces, two diaphragms the outer edges of which are sealed with respect to the casing and which respectively divide the said spaces axially each into an axially inner chamber and an axially outer chamber, a hollow push-rod mounted for sealed reciprocating movement in the centre body to transmit axial displacing forces between the two diaphragms, a shaft extending axially in a sealing manner through the hollow push-rod and through the end-caps, passage means extending along the shaft for conveying operating fluid to and from at least one of the two axially outer chambers formed between the respective end-caps and their adjacent diaphragms, said push-rod co-operating with the shaft to control communication between said passage means and said one or both of said two axially outer chambers and means operating in conjunction with the shaft to clamp the end-caps to the centre body.

The two end-caps may advantageously be of conical or of convexly curved form. The radially outer edges of the two diaphragms may conveniently be clamped between the outer rims of the respective end-caps and the centre body.

According to a preferred feature of the invention said passage means includes two passages for respectively transmitting pressure signals indicative of the approach of the push-rod to its two axial end positions, the push-rod operating adjacent opposite ends of its stroke to uncover one or other of a pair of ports opening to said passages respectively thereby to place the port in communication with said two axially outer chambers respectively.

One embodiment of the invention will now be described with reference to the accompanying drawings in which.

Figure 1:
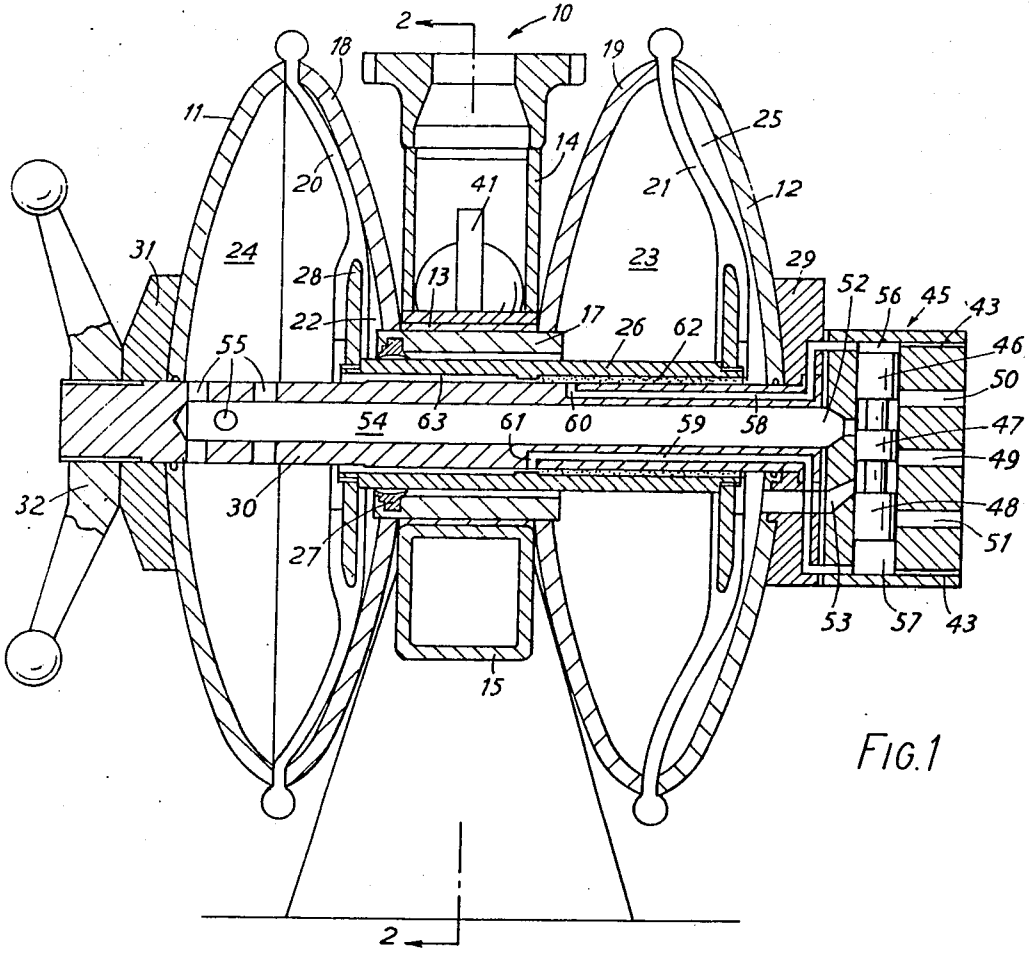
FIG. 1 shows a pump according to the invention in axial section.

Referring to the drawings the pump comprises a casing including a centre body 10 and two end-caps 11, 12. The centre body is of fabricated construction and comprises a central box 13, upper and lower boxes 14, 15 clamped to the top and bottom of the central box by bolts 16, an axial bush 17 extending through the central box and forming a partition therein, and two inner chamber members 18, 19 of arcuate section welded to the bush 17 and the central box 13.

The two end-caps 11, 12 are of convexly curved form and have their outer rims disposed for axial abutment with the outer rims of the two inner chamber members 18, 19 through the outer edge portions of two diaphagms 20, 21, which are respectively disposed between the rims of the end-caps 11, 12 and inner chamber members 18, 19. Thus there are formed two axially inner chambers 22, 23 and two axially inner chambers 22, 23 and two axially outer chambers 24, 25. The two diaphragms 20, 21 are connected to opposite ends of a hollow push-rod 26 extending through the bush and sealed with respect to the bush by a sealing ring 27. The diaphragms are stiffened in their central areas by embedded plates 28.

A sealing ring 29 is disposed against the convex outer face of the end-cap 12 and has its complementary face concavely curved. The opposite face of the seating ring is rebated about the central aperture of the ring and the rebate accommodates a radial flange formed on one end of a shaft 30 which extends axially through end-cap 12, hollow push-rod 26, end-cap 11 and a second seating ring 31. The opposite end of the shaft is screw-threaded and carries a nut 32 which is tightened to clamp the edges of the diaphragms 20, 21 firmly between the rims of the end-caps and inner chamber members and to secure the whole assembly together.

Each of the two spaces 33, 34 formed between the bush 17 and the walls of the central box 13 contains a ball 35 co-operating with a valve seating ring 36 disposed about an aperture in the bottom wall of the box, which aperture registers with a corresponding aperture 37 in the top wall of the lower box. At one side of the lower box a flanged inlet connection 38 is formed. The upper box 14 similarly houses two balls 39 disposed in apertures in the bottom wall of the box and operating as valve members co-operating with valve seating rings extending about complementary aperatures 40 in the top wall of the central box. Posts 41 mounted on the bottom wall of the upper box serve as guides for the balls. An aperture 42 in one axial end wall of space 34 of the central box opens to the chamber 22 formed between inner chamber member 18 and diaphragm 20, and an aperture in the opposite axial end wall of space 33 opens to the chamber 23 formed between inner chamber member 19 and diaphragm 21. The balls 35 in the central box act as non-return valves for enabling the liquid being pumped to be drawn from the lower box 15 into the two spaces 33, 34 in the central box alternately and hence into one or other of the chambers 22, 23 according to the direction of movement of the diaphragm and push-rod assembly, while the balls 39 in the upper box act as non-return valves permitting pumped fluid from the chamber 22 or 23 whose volume is decreasing to pass therethrough into the upper box 14 and thence out through a flanged outlet connection 44 of the box.

The push-rod/diaphragm assembly is reciprocated by air under pressure supplied to the two outer chambers 24, 25 alternately from a conventional form of change-over spool-valve 45 mounted on the seating ring 29. The spool-valve member has three lands 46, 47, 48 co-operating with a supply port 49 for air under pressure, two exhaust ports 50, 51, a first inlet/exhaust port 52 associated with outer chamber 24 and a second inlet/exhaust port 53 leading to outer chamber 25 and small-diameter bleed passages 43 open to atmosphere. The first inlet/exhaust port 52 opens to a large diameter passage 54 extending axially along the shaft and connecting with the air chamber by way of ports 55 in the shaft. From the two end chambers 56, 57 of the spool valve, passages extend through the valve housing and communicate with respective passages 58, 59 extending along the shaft to axially spaced ports 60, 61 in the shaft. A sealing sleeve 62 is secured to the internal surface of the push-rod 26 and co-operates with ports 60, 61 to control the operation of the spool valve. The sleeve also forms a seal preventing the leakage of air between the two chambers 24, 25.

Figure 2:
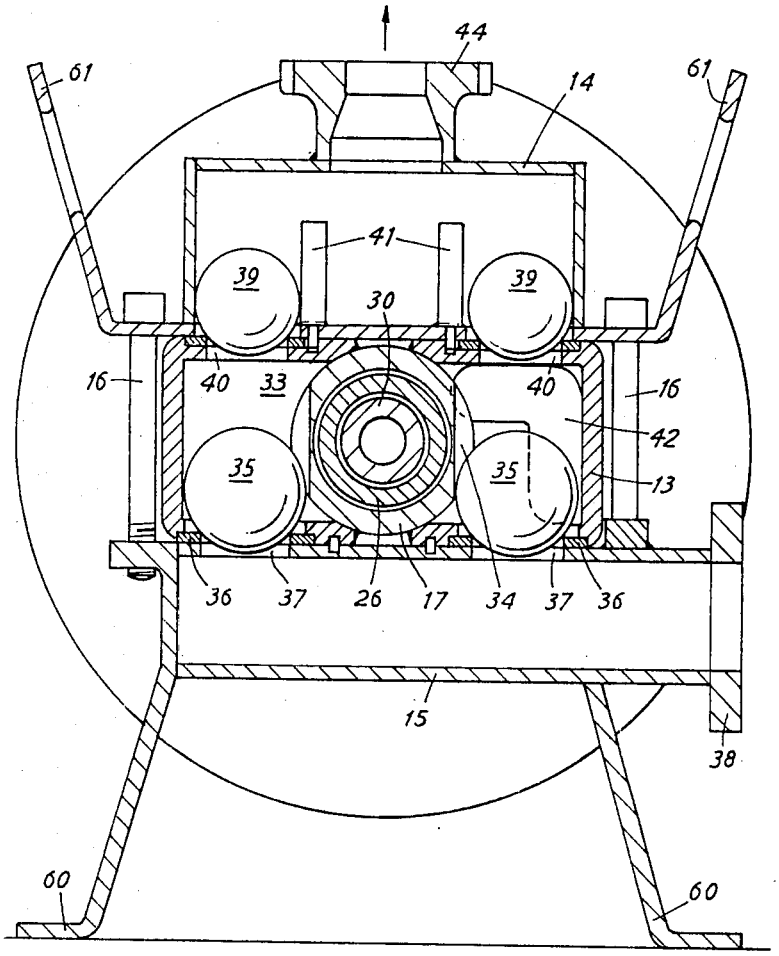
FIG. 2 is a sectional end elevation on the plane 2—2 of FIG. 1.

The operation is as follows:

When the diaphragm/push-rod assembly is in its right hand end position as shown, air under pressure is supplied from port 49 to outer chamber 25 and moves the assembly leftward, outer chamber 24 being in communication with exhaust port 50 by way of ports 55, passage 54 and port 52. During the resulting expansion of chamber 22 and contraction to chamber 23 liquid is drawn past the right hand ball 35 shown in FIG. 2 and through aperture 42 into chamber 22 and liquid in chamber 23 is expelled through chamber 33, past the left hand ball 39 in FIG. 2, into the box 14 and thence through the outlet flange connection 44. As the diaphragm/push-rod assembly reaches the left hand end of its movement, the sealing liner 62 uncovers port 60 in shaft 30 allowing air under pressure from chamber 25 to flow through the port to the bleed chamber 56 of spool valve 45 more quickly than the bleed passage 43 permits it to escape so that the spool valve member is moved to its opposite end position, connecting chamber 25 to exhaust port 51 and connecting chamber 24 to the supply port 49 by way of passage 54 along shaft 30. The assembly then moves rightward expelling the liquid from chamber 22 to the outlet connection 44 and drawing a fresh charge into chamber 23. At the end of the rightward movement port 61 is uncovered by the sealing liner 62 permitting air from chamber 24 to flow along an annular gap 63 between shaft 30 and push-rod 26 to chamber 57 and increasing the pressure in chamber 57 and causing the spool valve member to be moved to its other end position. The initial movement of the assembly from either of its end positions blanks off the port 60 or 61 and allows the air in the bleed chambers 56 or 57 to escape to atmosphere through the passages 43.

The centre body is conveniently provided with feet 60 and carrying handles 61.

In a modified construction, not illustrated, the end-caps 11 and 12 and the inner chamber members 18 and 19 have radial flanges at their outer peripheries and the peripheral beads 20*a*, 21*a* of the diaphragms 20, 21 are sealingly accommodated in complementary grooves in the abutting faces of these flanges. Also the bush 17 is omitted and sealing ring 27 is accommodated in an annular boss formed at the radially inner periphery of member 18. The central box 13 extends inward to a location adjacent the push-rod 26 and chambers 33, 34 are sealed from each other by a vertical wall disposed adjacent but spaced from the surface of push-rod 26.

I claim:

1. A pump having a casing comprising a centre body and two end-caps disposed at opposite axial sides of the centre body and forming with centre body respective spaces, two diaphragms the outer edges of which are sealed with respect to the casing and which respectively divide the said spaces axially each into an axially inner chamber and an axially outer chamber, a hollow push-rod mounted for sealed reciprocating movement in the centre body to transmit axial displacing forces between the two diaphragms, a shaft extending axially in a sealing manner through the hollow push-rod and though the end-caps, passage means extending along the shaft for conveying operating fluid to and from at least one of the two axially outer chambers formed between the respective end-caps and their adjacent diaphragms, said push-rod co-operating with the shaft to control communication between said passage means and said one or both of said two axially outer chambers and means operating in conjunction with the shaft to clamp the end-caps to the centre body.

2. A pump as claimed in claim 1, wherein the end-caps are of substantially conical form.

3. A pump as claimed in claim 1, wherein the end-caps are of convexly curved form.

4. A pump as claimed in claim 1, wherein the diaphragms have the radially outer edges thereof clamped between the outer edges of the respective end-caps and the centre body.

5. A pump as claimed in claim 1, wherein said passage means includes two passages for respectively transmitting pressure signals indicative of the approach of the push-rod to its two axial end positions, the push-rod operating adjacent opposite ends of its stroke to uncover one or other of a pair of ports opening to said passages respectively thereby to place the port in communication with said two axially outer chambers respectively.

6. A pump as claimed in claim 5, wherein the shaft has secured to one end thereof a change-over spool valve comprising a housing and a spool valve member mounted for reciprocating movement in a bore in the housing, the two ends of the bore each communicating with the ambient atmosphere via a restricted orifice and the two ends of the bore communicating with the said two passages respectively.

* * * * *